US011130610B2

(12) United States Patent
Tasch et al.

(10) Patent No.: US 11,130,610 B2
(45) Date of Patent: Sep. 28, 2021

(54) MERCHANDISE STORAGE AND DISPLAY MOUNT

(71) Applicants: Josiah M. Tasch, Belmont, MI (US); Joshua D. Caldecourt, Fort Collins, CO (US); Timothy J. Lancaster, Ault, CO (US)

(72) Inventors: Josiah M. Tasch, Belmont, MI (US); Joshua D. Caldecourt, Fort Collins, CO (US); Timothy J. Lancaster, Ault, CO (US)

( * ) Notice: Subject to any disclaimer, the term of this patent is extended or adjusted under 35 U.S.C. 154(b) by 208 days.

(21) Appl. No.: 16/422,393

(22) Filed: May 24, 2019

(65) Prior Publication Data

US 2019/0359372 A1 Nov. 28, 2019

Related U.S. Application Data

(60) Provisional application No. 62/676,678, filed on May 25, 2018.

(51) Int. Cl.

| | |
|---|---|
| ***B65D 5/20*** | (2006.01) |
| ***B65D 5/38*** | (2006.01) |
| ***B65D 5/42*** | (2006.01) |
| ***B65D 5/44*** | (2006.01) |
| ***B65D 5/50*** | (2006.01) |

(52) U.S. Cl.

CPC ..... *B65D 5/2057* (2013.01); *B65D 5/38* (2013.01); *B65D 5/4266* (2013.01); *B65D 5/443* (2013.01); *B65D 5/5038* (2013.01); *B65D 5/505* (2013.01)

(58) Field of Classification Search

CPC ..... B65D 5/2057; B65D 5/38; B65D 5/5038; B65D 5/505; B65D 5/443; B65D 5/4266; B65D 73/00; B65D 73/007; B65D 73/0014; B65D 73/0012; B65D 73/0064; B65D 73/0071

USPC ..... 206/495, 775–778, 722, 493, 489, 477, 206/320

See application file for complete search history.

(56) References Cited

U.S. PATENT DOCUMENTS

| | | | | | |
|---|---|---|---|---|---|
| 2,600,023 | A | | 12/1950 | Rice | |
| 2,781,898 | A | * | 2/1957 | Desmond | B65D 5/5026 206/527 |
| 3,675,763 | A | * | 7/1972 | Sandel | B65D 5/4204 206/387.11 |
| 3,921,895 | A | * | 11/1975 | Ziche | B65D 5/5021 206/486 |
| 3,990,578 | A | * | 11/1976 | Roeser | B65D 73/0085 206/461 |
| 4,062,447 | A | | 12/1977 | Gardner | |
| 4,125,185 | A | * | 11/1978 | Bliss | B65D 5/4204 206/426 |

(Continued)

*Primary Examiner* — Chun Hoi Cheung
(74) *Attorney, Agent, or Firm* — Zollinger & Burleson Ltd.

(57) ABSTRACT

A merchandise storage and display mount includes a support that fits within a recess of the merchandise to be stored and displayed. The merchandise can be a five-sided protective case for a hand-held electronic device. The case defines an recess that receives a portion of the mount. The mount is formed from a foldable material and can be erected from a flat blank by folding the material and gluing at selected locations. The mount includes stiffeners that add durability to the mount. The mount is durable and can be used in combination with different merchandise storage devices.

24 Claims, 11 Drawing Sheets

(56) References Cited

U.S. PATENT DOCUMENTS 4,160,502 A * 7/1979 Roccaforte ..... B65D 5/5014 206/486
5,469,959 A * 11/1995 Gummer ..... B65D 73/0078 206/299
5,593,030 A 1/1997 Tell
5,636,746 A * 6/1997 McQueeny ..... B65D 5/2038 206/746
5,819,928 A 10/1998 Wynalda, Jr.
5,823,352 A * 10/1998 Mena ..... B65D 5/4204 206/721
6,375,003 B1 4/2002 Lethen et al.
6,845,865 B2 1/2005 Wynalda, Jr. et al.
7,028,839 B2 * 4/2006 Belloli ..... B65B 21/242 206/443
7,798,321 B2 9/2010 Wynalda, Jr. et al.
7,798,322 B2 9/2010 Wynalda, Jr. et al.
7,989,041 B2 8/2011 Wynalda, Jr. et al.
8,181,788 B2 * 5/2012 Meneses ..... B65D 5/6667 206/765
8,616,373 B2 * 12/2013 Hansen ..... B65D 43/169 206/463
9,561,890 B2 2/2017 Denney
9,725,230 B2 * 8/2017 Huang ..... B65D 73/0078
10,059,497 B2 * 8/2018 Rehberg ..... B65D 73/0021
10,273,039 B2 4/2019 Longberg
2002/0130055 A1 * 9/2002 Morrison, Jr. ..... B65D 73/0078 206/297
2004/0149601 A1 * 8/2004 Carty ..... B65D 5/422 206/232
2006/0237337 A1 10/2006 Irie et al.
2008/0017536 A1 1/2008 Wynalda, Jr. et al.
2008/0202957 A1 8/2008 Lacko et al.
2012/0061272 A1 * 3/2012 Wagner ..... B65D 5/4208 206/320

* cited by examiner

MERCHANDISE STORAGE AND DISPLAY MOUNT

CROSS REFERENCE TO RELATED APPLICATIONS

This application claims the benefit of U.S. Provisional Patent Application No. 62/676,678 filed May 25, 2018; the disclosures of which are incorporated herein by reference.

BACKGROUND OF THE INVENTION

1. Technical Field

The present disclosure generally relates to devices and apparatus used to store merchandise and display the merchandise to a potential consumer. More particularly, the disclosure relates to a merchandise storage and display mount erected by folding and gluing a material such as paperboard. Specifically, the disclosure relates to a mount used to hold and display a protective case for a portable electronic device wherein the mount includes a support that simulates the portable electronic device that is to be inserted into the protective case.

2. Background Information

Various types of merchandise storage and display packaging are known in the art for use with protective cases for portable electronic devices. Most protective cases are five-sided shells that define a recess or opening that matches the size of the device for which the case is to be used. The manufacturers and retailers of these cases desire a functional and attractive package useful for shipping the case from the manufacturer to the retailer, for displaying the case to the potential customer, and for allowing the customer to interact with the case by at least touching and feeling at least a portion of the case. Some retailers want the ability to remove the case from the package and try it on a customer's device and then replace it without damaging the packaging.

One solution is a five-sided sleeve that carries a slide-out tray with the case carried in the tray. Some of these trays use a formed recess to frictionally receive the case. Molding trays with the custom recesses for all the different case sizes takes time and is relatively high cost to create all of the different molds for the different sizes. When the case is disposed down in the recess, the customer cannot always touch the sidewalls without removing the case from the tray. Other packaging solutions receive the cases loosely. Another solution is a six-sided box with a pivoting lid.

Those who make and sell products such as cases that have recesses or openings to receive items desire ever-improving storage and display solutions.

BRIEF SUMMARY OF THE DISCLOSURE

The disclosure provides a merchandise storage and display mount that includes a support that fits within a recess of the merchandise to be stored and displayed. The mount is formed from a foldable material and can be erected from a flat blank by folding the material and gluing at selected locations. The mount is durable and can be used in combination with different merchandise storage devices such as sleeves and boxes.

The disclosure provides an exemplary configuration wherein the support that fits within the recess of the merchandise to be displayed includes side walls, end walls, and first and second internal stiffeners disposed in different directions to increase the stiffness of the support and to increase the durability of the support. In the exemplary configuration, the first and second internal stiffeners are disposed perpendicular to each other.

The disclosure provides a merchandise storage and display mount with a support that mimics the dimensions of a portable electronic device such as a mobile phone or tablet computer. The support removably and replaceably receives the protective case to allow a customer to view and touch the case while contemplating purchase. The corners of the support are cantilevered so that they can flex up and down to snap fit into the protective case.

The disclosure provides an exemplary configuration wherein the support extends up from a double-thickness base that defines slots that receive locking flanges extending from the end walls of the support.

The disclosure provides an exemplary configuration wherein the support includes an internal box structure having a broad surface adhered to the upper surface of the base to provide stiffness to the support.

The device of the disclosure can be supplied to the user in a flat configuration and then erected manually or erected by automated equipment. The erected configuration is durable to allow the merchandise to be mounted, removed, and replaced multiple times. The device is adaptable for use with trays, boxes, flat displays, and other existing packaging options. The device does not require a mold to be created for the support which allows the external dimension of the support to be changed without creating a new mold for each new product to be carried by the device.

The preceding non-limiting aspects of the disclosure, as well as others, are more particularly described below. A more complete understanding of the devices, systems, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
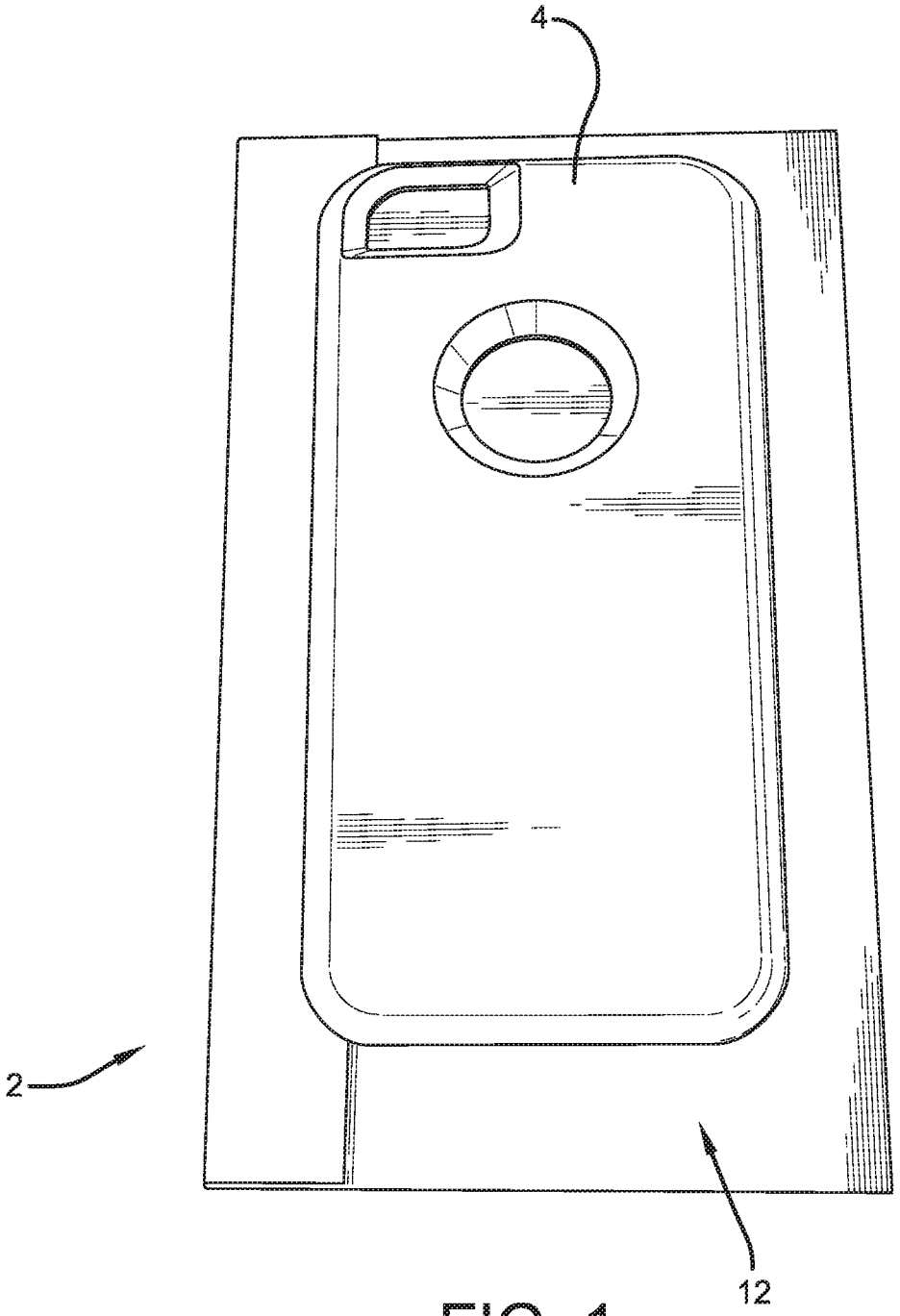
FIG. 1 is a top view of an exemplary merchandise storage and display mount used with a protective phone case disposed on the mount.
Figure 2:
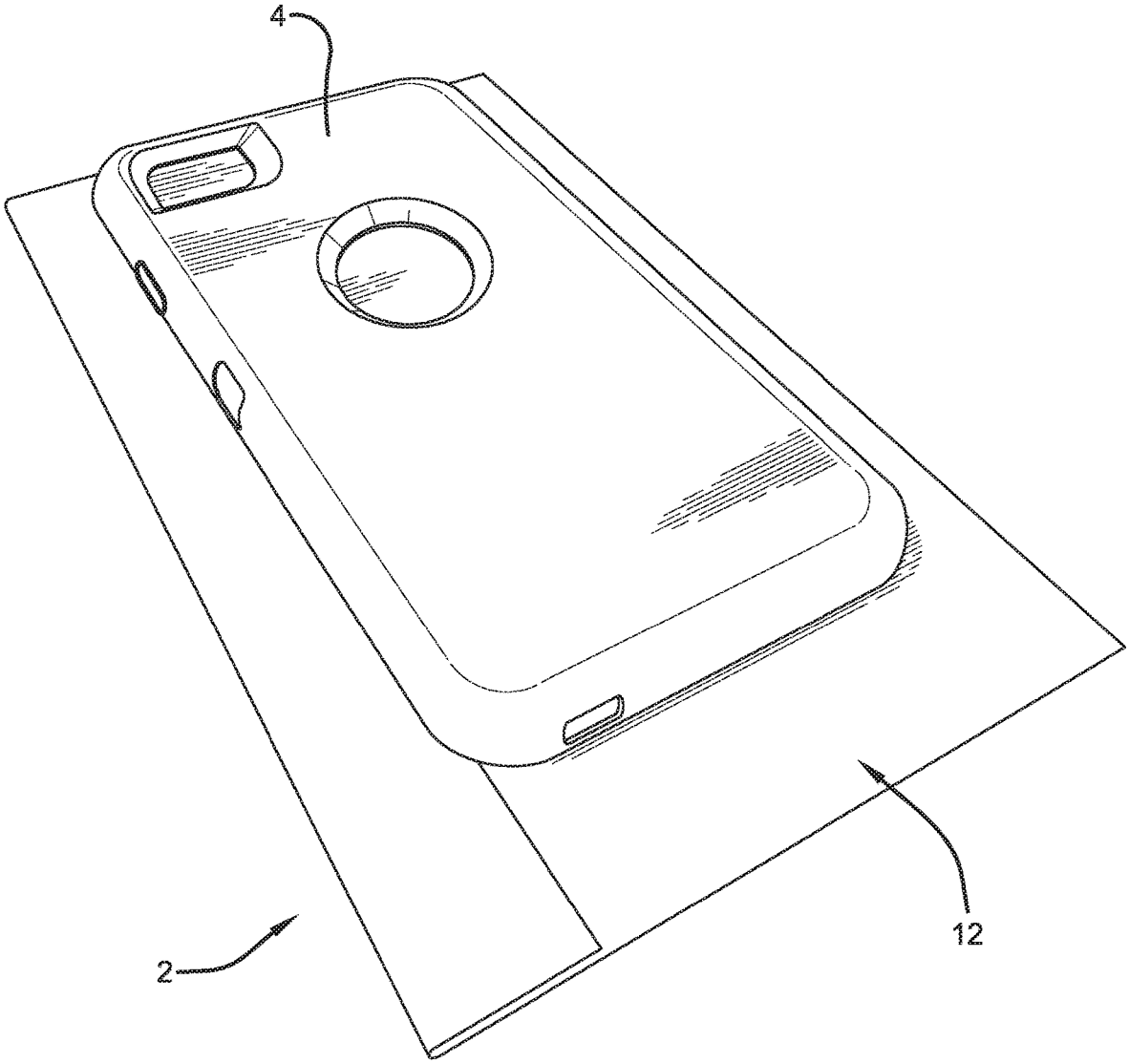
FIG. 2 is another perspective view of the mount of FIG. 1 showing the option of using a support that is tall enough to lift the lower surface of the case above the upper surface of the base of the mount.

An exemplary configuration of the storage and display mount is indicated generally by the numeral 2 in the accompanying drawings. Exemplary mount 2 is sized to support a phone case 4 by providing a raised support 10 sized to fit within the recess defined by case 4. Support 10 can be sized to fit loosely within the recess defined by case 4, although sizing mount 10 to frictionally fit or snap fit provides an optional retention force to support 10. In the exemplary configuration, support 10 is taller than case 4 to position case 4 in a spaced configuration from the base 12 of mount 2. Phone case 4 is provided as an example of an item of merchandise that can be used with mount assembly 2. Various protective cases 4 for portable electronic devices such as phones and tablet computers can be stored and displayed on mount 2. Further, other items of merchandise that define recesses or holes can be used with supports 10 being sized and shaped for those items. The particular size and shape of support 10 described herein is exemplary.

Figure 3:
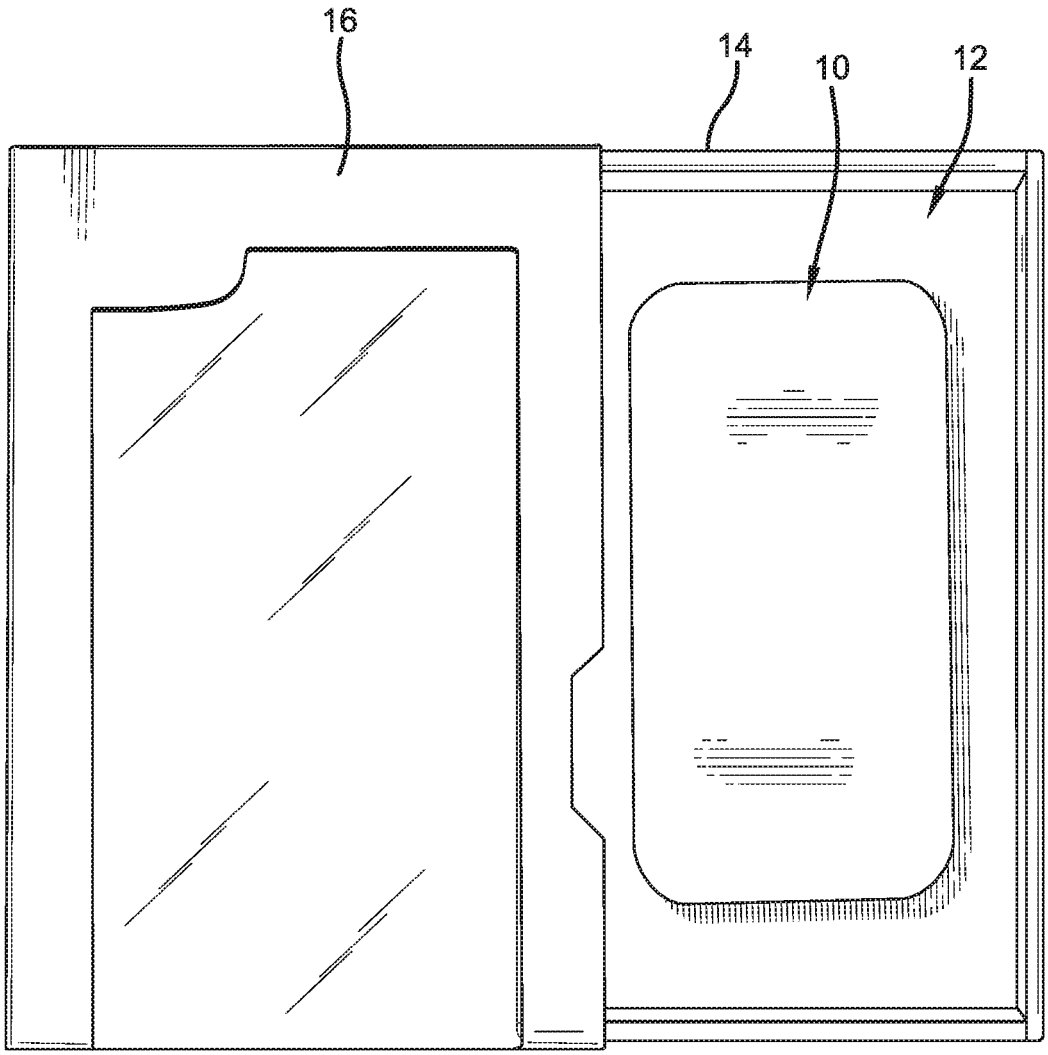
FIG. 3 is a top plan view of the exemplary merchandise storage and display mount of FIG. 1 used in combination with a slide out tray and outer protective sleeve.
Figure 4:
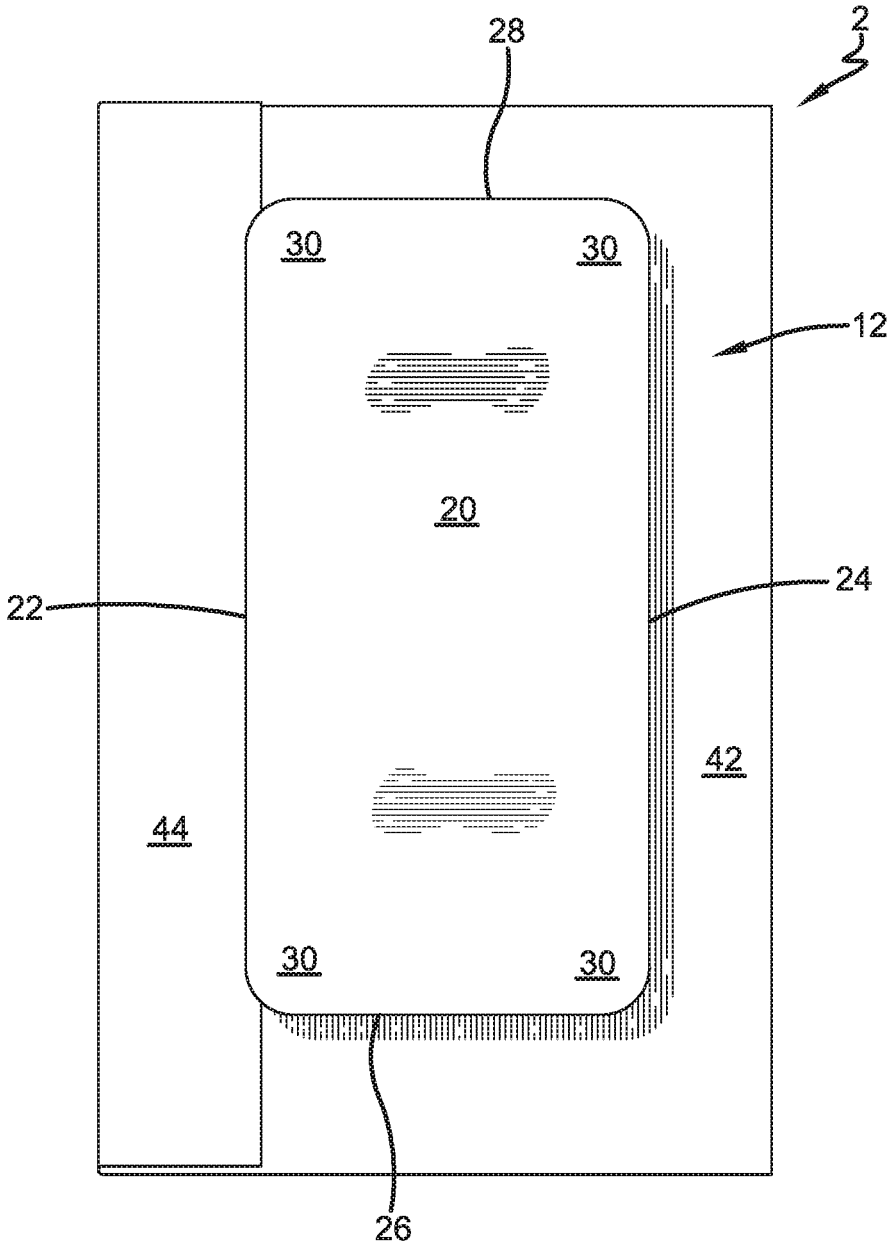
FIG. 4 is a top plan view of the exemplary merchandise storage and display mount of FIG. 1.

FIG. 3 shows an example of mount 2 used in combination with a tray 14 and a sleeve 16. In this example, tray 14 carries mount 2 and slides back and forth within sleeve 16. Mount 2 can be used on its own or in combination with other merchandise packaging devices. Examples include boxes, trays, flat displays, envelopes, tubes, and the like. Mount 2 can be separately-formed and connected to the packaging device or mount 2 can be integrated into the packaging device. For example, base 12 can be provided in the form of tray 14 for use with sleeve 16.

Figure 8:
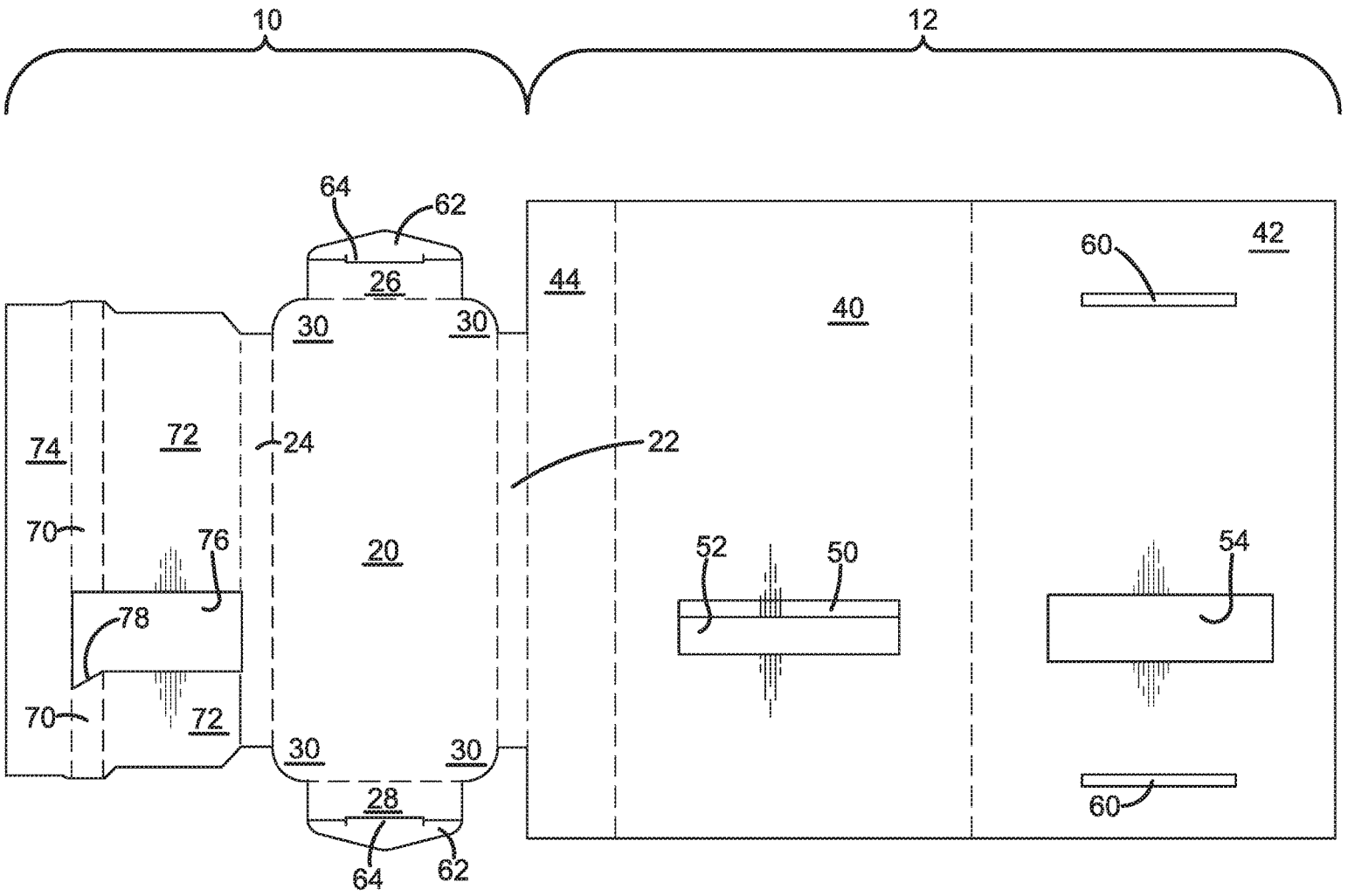
FIG. 8 is a top plan view of the blank used to form the exemplary mount of FIGS. 1-7.

FIGS. 4-8 depict the structural elements of mount 2 and show how these elements fit together and cooperate to provide a durable device that can be used multiple times to store an item of merchandise such as case 4. FIG. 8 depicts the flat blank that, when die cut and the folds prepared, can be readily erected into mount 2 by folding along the fold lines and gluing in the identified locations. In the exemplary configurations, all of the elements of mount 2 are integral and formed from a single flat piece of foldable material such as paperboard or polymer board. In the exemplary configuration, the foldable material is a 0.018 Solid Bleached Sulphate (SBS) paperboard. In other configurations, the elements can be formed separated and joined.

Figure 5:
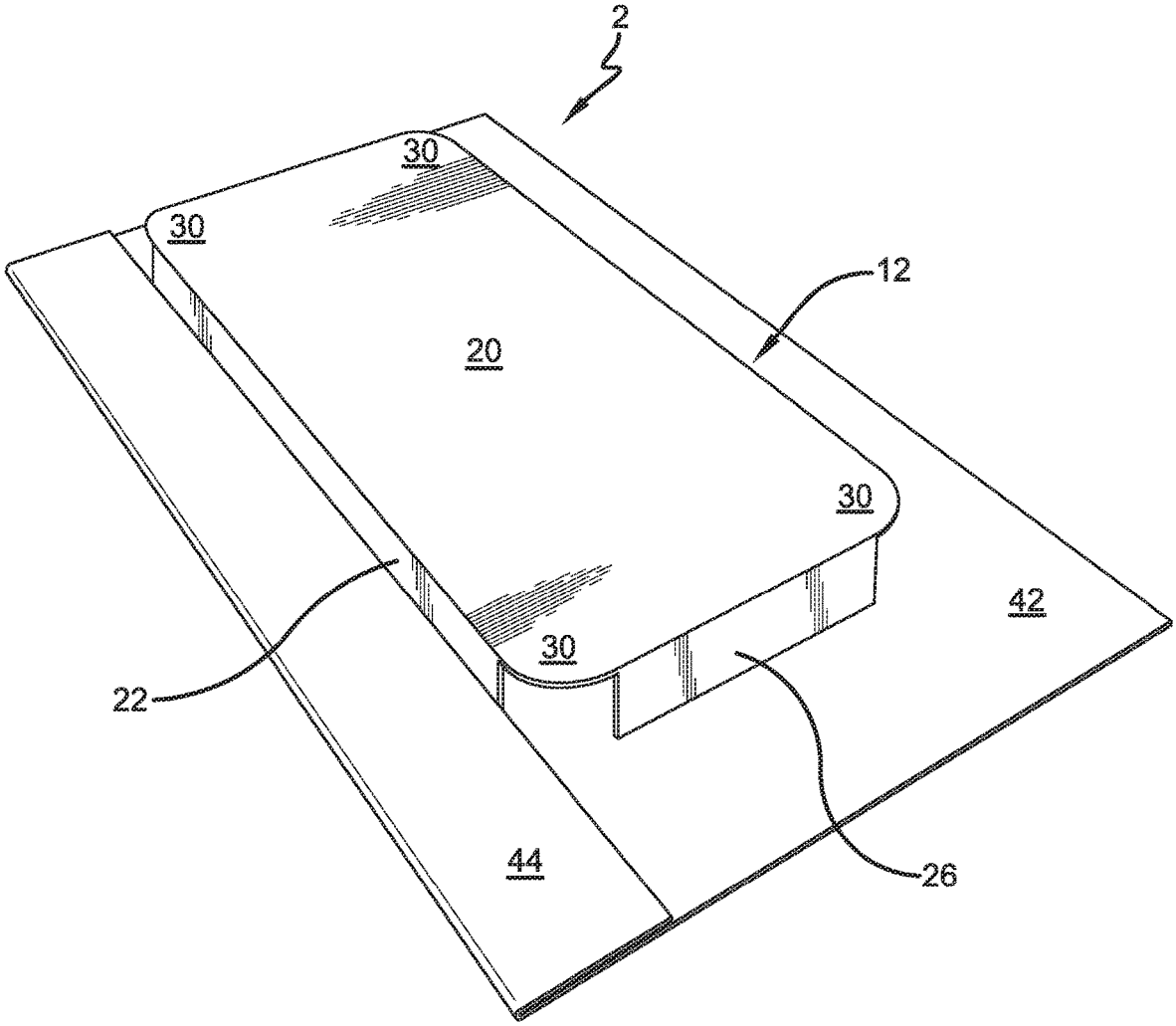
FIG. 5 is a perspective view of the exemplary merchandise storage and display mount of FIG. 1.
Figure 6:
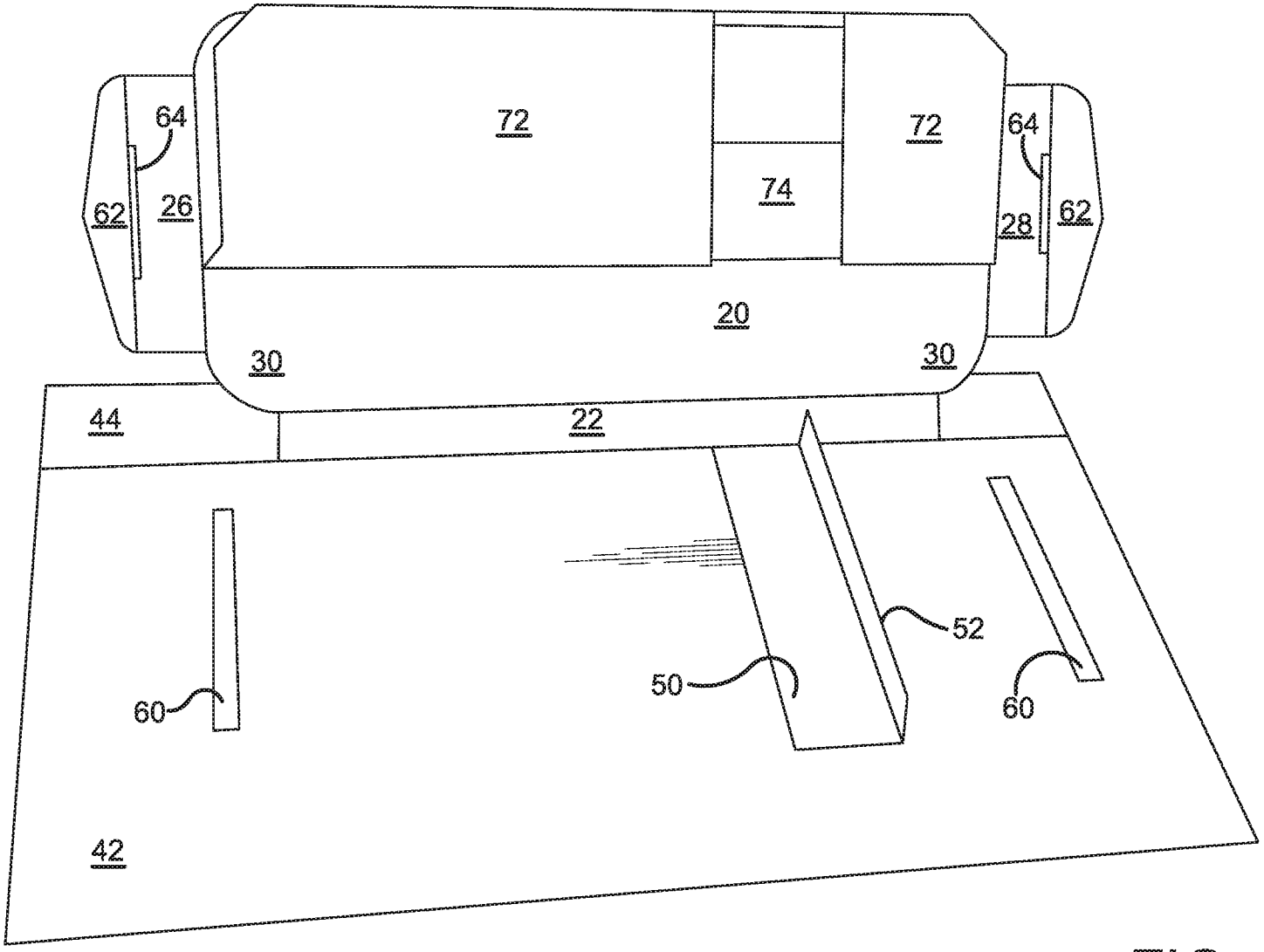
FIG. 6 is a view showing a step in the erection process of the mount wherein the internal box has been formed under the top wall of the mount.
Figure 7:
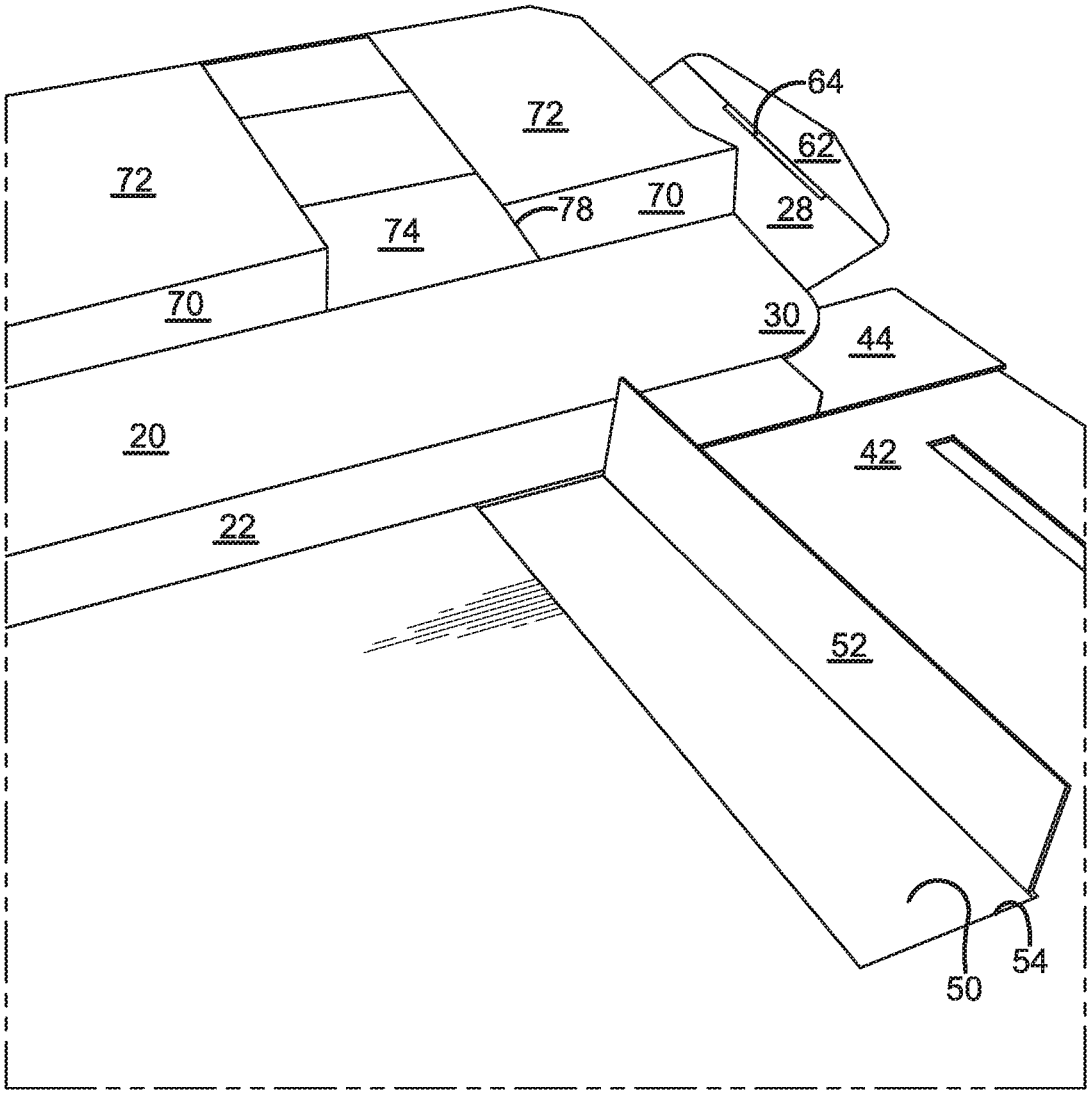
FIG. 7 is an enlarged view showing the angle of the opening in the internal box that receives the first internal stiffener that extends up from the base.

Support 10 includes a top wall 20, a first side wall 22, a second side wall 24, a first end wall 26, and a second end wall 28. Top wall 20 is substantially parallel to base 12. Side walls 22 and 24 are parallel to each other and disposed perpendicular to end walls 26 and 28. The dimensions of each of these walls are determined by the size of the recess or opening defined by the merchandise to be mounted on support 10. In the exemplary configuration, support 10 is configured to mimic the size of the phone for which case 4 is designed. In this example, the corners 30 of top wall 20 are rounded to match the curved corners of the phone that would be protected by case 4. The height of support 10 is defined by the width of walls 22, 24, 26, and 28. In this example, the height is tall enough to lift case 4 above the upper surface of base 12. FIG. 5 depicts that support 10 includes open corners 30 wherein the ends of side walls 22 and 24 are spaced apart from the ends of end walls 26 and 28. The rounded corners 30 are thus unsupported from below and can flex up and down. In some configurations, corners 30 are sized to engage the corners of case 4, flex, and then snap fit into the corners of case 4 when case 4 is pressed onto support 10.

Base 12 has a double thickness to provide rigidity to mount 2 as well as providing structural support features to mount 2. Base 12 includes a rear panel 40 having first and second edges, a front panel 42 having first and second edges, and an edge panel 44 having first and second edges. Front panel 42 is connected to rear panel 40 at their second edges with a fold. Front panel 42 is folded over the top of rear panel 40 with an inner surface of front panel 42 facing an inner surface of rear panel 40. Edge panel 44 is connected to rear panel 40 at their first edges with a fold. Edge panel 44 is folded over the top of rear panel 40 and the first edge of front panel 42 to define base 12. Front panel 42 has a smaller width than rear panel 40 so that edge panel 44 can be folded over the free first edge of front panel 42 to define a substantially flat base 12.

Figure 9:
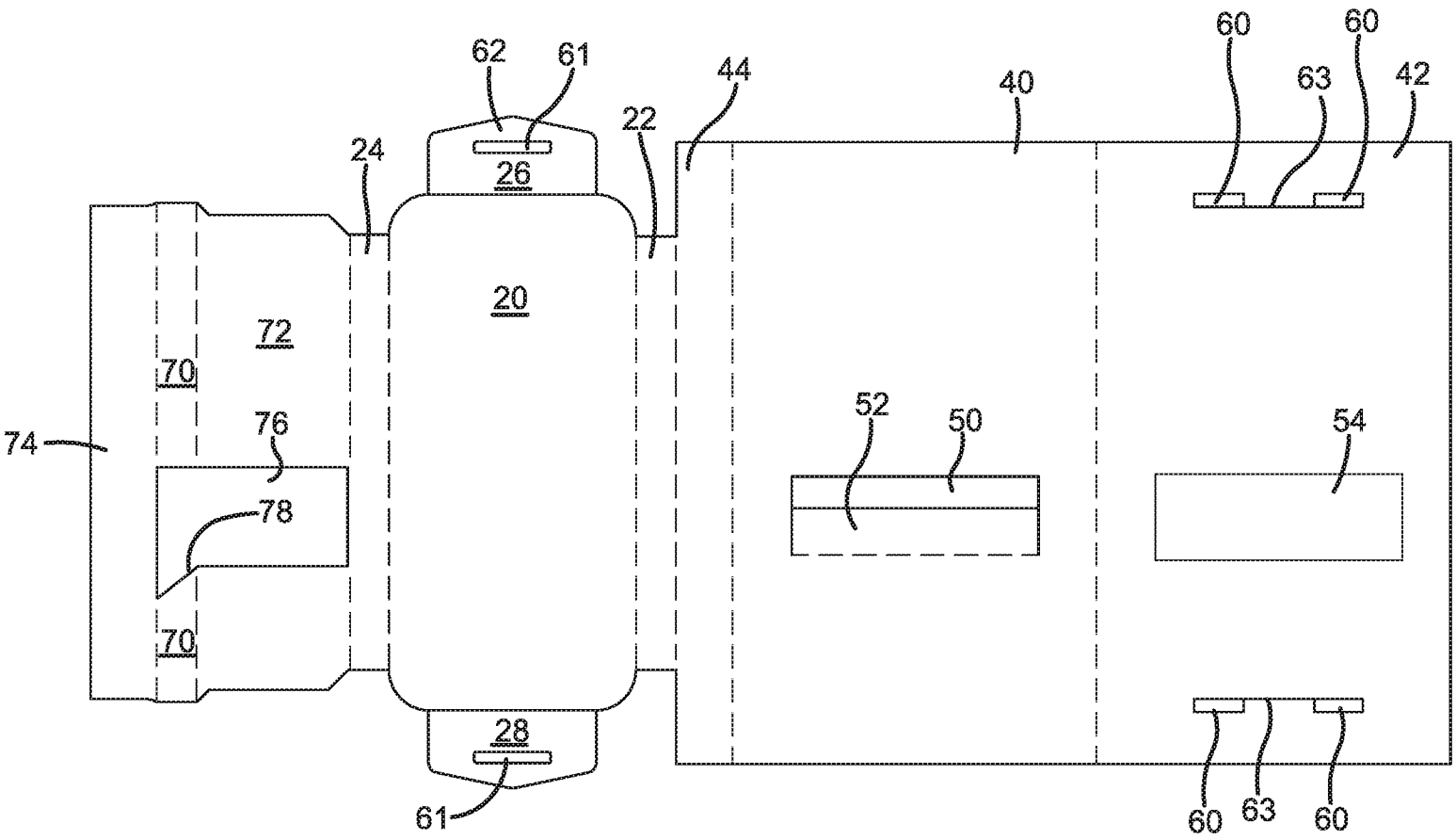
FIG. 9 is a top plan view of a blank used to form an alternative configuration of the exemplary mount.
Figure 10:
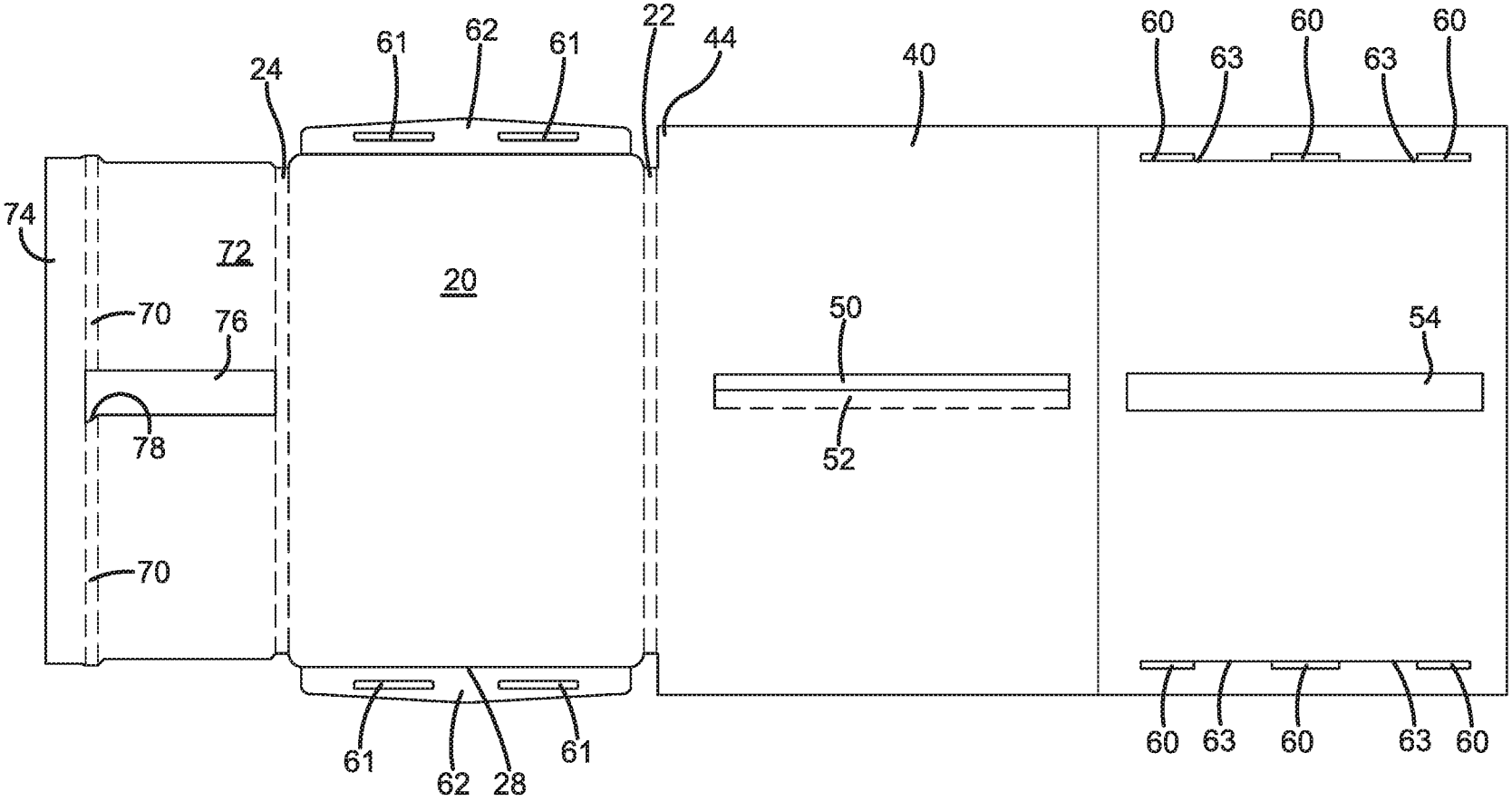
FIG. 10 is a top plan view of a blank used to form another alternative configuration of the exemplary mount.

FIGS. 8, 9, and 10 depict flat blanks that are erected by folding into mounts 2. The dashed lines indicate where the folds are made during the erection process. These fold lines can be scored, pre-breaked, or indented. The folds can be front fold or inverse folds. Adhesive is used to secure the elements of mount 2 together. The adhesive can be provided in lines, dots, or spread over wide areas. For example, to increase the stiffness of support 10, the entire contact surface between the internal box and front panel 42 can be coated with adhesive.

Rear panel 40 defines a rear panel opening 50 with a first internal stiffener 52 projecting from rear panel 40 into opening 50. Front panel 42 defines a front panel opening 54 that is aligned with opening 50 when front panel 42 is folded over onto rear panel 40. This alignment allows first internal stiffener 52 to be folded up from rear panel 40 and through front panel 42 to engage support 10. The ends of first internal stiffener 52 optionally engage the interior of side walls 22 and 24 to resist lateral movement by support 10. In an alternative configuration, first internal stiffener 52 can be rotated ninety degrees and sized such that its ends engage the interior of end walls 26 and 28. Openings 50 and 54 can be used to secure assembly 2 to another packaging device such as tray 14 depicted in FIG. 3. Openings 50 and 54 expose a portion of the interior of support 10 and tray 14 can include a projection that fills this opening.

Figure 11:
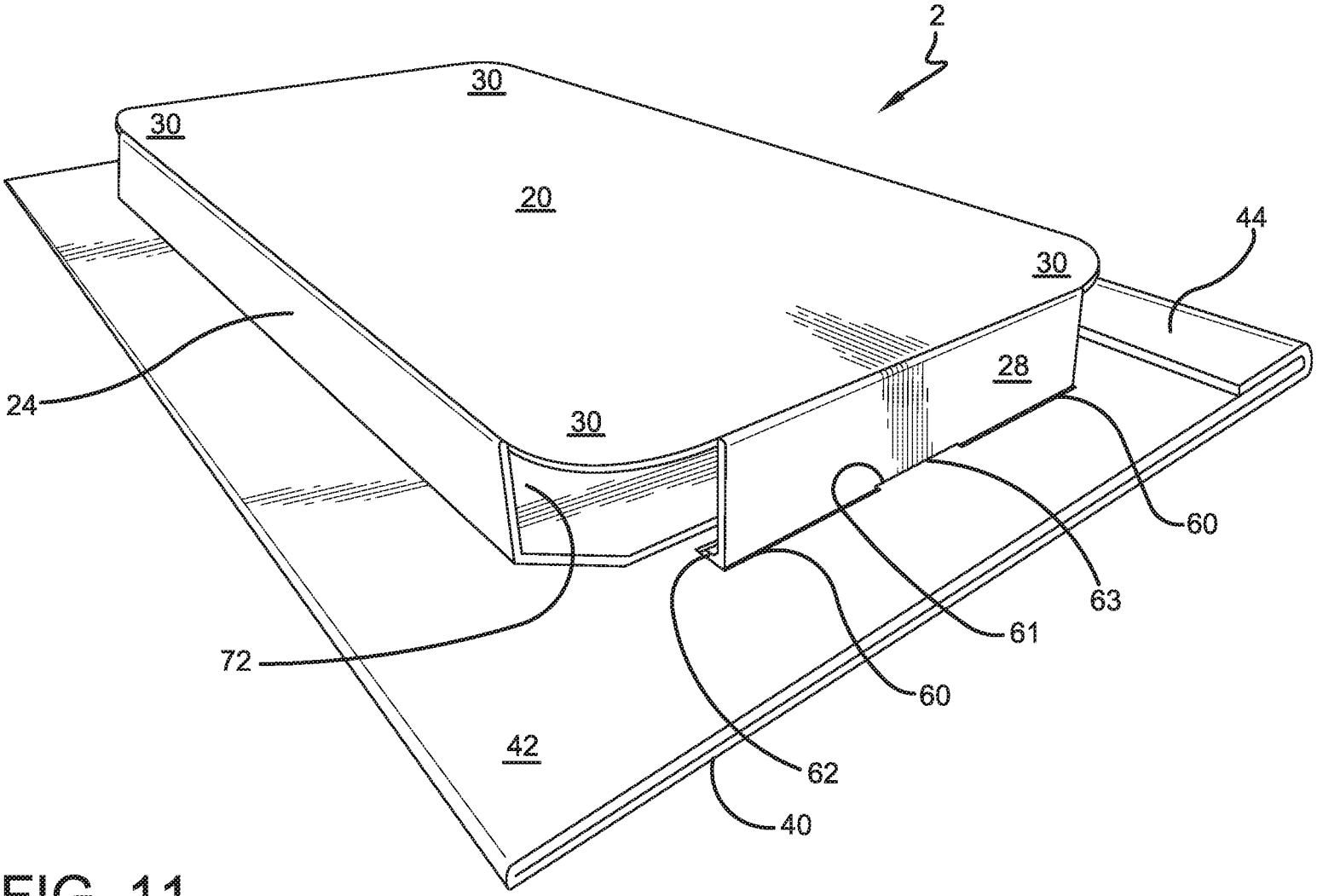
FIG. 11 is a view of the end wall configuration of FIG. 10.

Front panel 42 defines a pair of slots 60 aligned with end walls 26 and 28. Slots 60 receive locking flanges 62 that project from the ends of end walls 26 and 28. Locking flanges 62 slide into slots 60 to be disposed between front 42 and rear 40 panels. Each locking flange 62 can define a locking tab 64 along the fold that connects it to its end wall. Locking tab 64 includes small portion of the end wall and is disposed under front panel 42 when locking tabs 64 are slid in place to help hold the assembly in place. In the exemplary configurations of FIGS. 9-11, slots 61 are also defined by locking flanges 62 with locking tabs 63 being defined by front panel 42 and projecting into slots 60. In these configurations, locking flanges 62 are disposed between panels 40 and 42 with locking tabs 63 disposed in slots 61.

Support 10 also includes an internal box that itself includes at least a second internal stiffener 70 that is sized to engage the inner surfaces of end walls 26 and 28. Second internal stiffener 70 is longer than side walls 22 and 24 so that it can engage end walls 26 and 28. The internal box is made up of second internal stiffener 70, a bottom support wall 72, and a stiffener panel 74. Second internal stiffener 70 and bottom support wall 72 are each divided into first and second portions by a cut out 76 that is aligned with openings 50 and 54. The portion of cut out 76 that extends across second internal stiffener 70 defines an angled abutment wall 78. The intersection of angled abutment wall 78 and bottom support wall 72 is disposed to be next to the connection between rear panel 40 and first internal stiffener 52 such that first internal stiffener 52 engages angled abutment wall 78. The undercut angle of abutment wall 78 allows first internal stiffener 52 to be disposed at the same angle as wall 78 with respect to base 12 which helps to stiffen support 10. The height of first internal stiffener 52 is sufficient for the upper end of first internal stiffener 52 to engage the inner surface of stiffener panel 74 when stiffener 52 is disposed at the angle of wall 78. As such, the height of stiffener 52 is larger than the height of side walls 22 and 24. First and second internal stiffeners 52 and 70 are substantially perpendicular and engage the inner surfaces of the side and end walls of support 10 to add rigidity to support 10 and limit lateral movement of support 10 with respect to base 12.

Bottom support wall 72 is connected to the bottom edge of side wall 24 and is glued to the top surface of front panel 42 to provide a strong connection between support 10 and base 12. Similarly, stiffener panel 74 is glued to the interior surface of top wall 20 to increase the thickness and rigidity of top wall 20. Stiffener panel 74 extends along most of the length of top wall 20 though slightly shorter than the length of second internal stiffener 70 that engages the inner surface of end panels 26 and 28.

Mount 2 thus provides a useful device for storing and displaying a protective case 4 in a manner than repeatedly allows case 4 to be mounted and dismounted, removed and replaced. Forming mount 2 from a foldable material allows the size and configuration of support 10 to be varied to match changes to the item of merchandise without the requirement of building a new mold. The configuration also allows the blanks for mount 2 to be shipped flat to the location where they are erected and placed into use.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are exemplary and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. An assembly of a storage and display mount carrying a protective case for a portable electronic device; the assembly comprising:

a base;

a support projecting up from the base;

the base and support being fabricated from a foldable material; and a protective case adapted for use with a portable electronic device; the protective case defining a recess; the support disposed in the recess of the protective case to removably and replaceably mount the protective case on the support.

2. The assembly of claim 1, wherein the support has a height above the base; the protective case having a height; the height of the support being larger than the height of the protective case such that the protective case is spaced from the base.

3. The assembly of claim 1, wherein the support engages the protective case to provide a retention force between the support and the protective case.

4. The assembly of claim 1, wherein the base and support are integrally formed from a single piece of foldable material.

5. The assembly of claim 1, wherein the base includes a rear panel having first and second edges, a front panel having first and second edges, and an edge panel having first and second edges; the edge panel disposed over a portion of the front panel.

6. The assembly of claim 5, further comprising a first internal stiffener disposed within the support; the first internal stiffener projecting from the rear panel of the base through the front panel of the base and into the support.

7. The assembly of claim 1, wherein the support includes a top wall having four corners, first and second spaced side walls, and first and second spaced end walls; each of the first and second side walls having ends and each of the first and second end walls having ends; and the ends of the side walls being spaced from the ends of the end walls such that the four corners of the top wall are unsupported from below.

8. The assembly of claim 7, further comprising a first internal stiffener disposed within the support; the first internal stiffener having first and second ends; the first end of the first internal stiffener engaging the first side wall and the second end of the first internal stiffener engaging the second side wall.

9. The assembly of claim 8, further comprising a second internal stiffener disposed within the support; the second internal stiffener having first and second ends; and the first end of the second internal stiffener engaging the first end wall and the second end of the second internal stiffener engaging the second end wall.

10. The assembly of claim 9, wherein the first internal stiffener is perpendicular to the second internal stiffener; the second internal stiffener defining an abutment wall; the first internal stiffener disposed against the abutment wall.

11. The assembly of claim 1, wherein the support has a top wall having four rounded corners that are unsupported and can flex up and down.

12. A merchandise storage and display mount comprising:

a base;

the base including a rear panel having first and second edges, a front panel having first and second edges, and an edge panel having first and second edges; the edge panel disposed over a portion of the front panel;

a support projecting up from the base; the support adapted to carry an item of merchandise;

first and second internal stiffeners disposed within the support;

the support and first and second internal stiffeners being fabricated from a single piece of foldable material;

the first internal stiffener projecting from the rear panel of the base through the front panel of the base and into the support;

the support including first and second spaced side walls and first and second spaced end walls;

the first internal stiffener having first and second ends;

the first end of the first internal stiffener engaging the first side wall and the second end of the first internal stiffener engaging the second side wall;

the second internal stiffener having first and second ends; and the first end of the second internal stiffener engaging the first end wall and the second end of the second internal stiffener engaging the second end wall.

13. The mount of claim 12, wherein the base is integrally formed from the single piece of foldable material.

14. The mount of claim 12, wherein the first internal stiffener is perpendicular to the second internal stiffener.

15. The mount of claim 14, wherein the second internal stiffener defines an abutment wall; the first internal stiffener disposed against the abutment wall.

16. The mount of claim 15, wherein the abutment wall is not perpendicular to the base.

17. The mount of claim 12, wherein the support includes a top wall having four corners.

18. The mount of claim 17, further comprising a stiffener panel connected to the top wall and the second internal stiffener; the first internal stiffener engaging the stiffener panel.

19. The mount of claim 12, wherein the support is integrally connected to the edge panel.

20. The mount of claim 12, wherein each end wall includes a locking flange disposed between the front and rear panels of the base.

21. A merchandise storage and display mount comprising:

a base;

a support projecting up from the base; the support adapted to carry an item of merchandise;

first and second internal stiffeners disposed within the support;

the support and first and second internal stiffeners being fabricated from a single piece of foldable material;

the support including first and second spaced side walls and first and second spaced end walls;

the first internal stiffener having first and second ends;

the first end of the first internal stiffener engaging the first side wall and the second end of the first internal stiffener engaging the second side wall;

the second internal stiffener having first and second ends;

the first end of the second internal stiffener engaging the first end wall and the second end of the second internal stiffener engaging the second end wall;

the support further including a top wall having four corners; and wherein each of the first and second side walls has ends and each of the first and second end walls has ends; the ends of the side walls being spaced from the ends of the end walls such that the four corners are unsupported from below.

22. A merchandise storage and display mount comprising:

a base;

a support projecting up from the base; the support adapted to removably and replaceably carry an item of merchandise;

the support including a top wall carried by a first side wall and a second side wall;

the top wall having four rounded corners that are unsupported and can flex up and down;

a stiffener panel connected to the top wall;

a bottom support wall connected to the second side wall and disposed against the base;

an internal support stiffener connected to both the stiffener panel and the bottom support wall.

23. The mount of claim 22, further comprising an internal base stiffener connected to the base; the internal base stiffener engaging the internal support stiffener and the stiffener panel.

24. The mount of claim 22, further comprising an internal base stiffener connected to the base; the internal base stiffener engaging an abutment wall defined by the internal support stiffener; the internal base stiffener disposed at a non-perpendicular angle to the base.

* * * * *